United States Patent [19]

MacLeod

[11] 4,123,622

[45] Oct. 31, 1978

[54] PROTECTIVE COVER FOR SOUND TRANSDUCERS LOCATED IN FACE MASKS OF DIVERS

[75] Inventor: Norman C. MacLeod, Sunnyvale, Calif.

[73] Assignee: Technology Development Corporation, Sunnyvale, Calif.

[21] Appl. No.: 787,342

[22] Filed: Apr. 14, 1977

[51] Int. Cl.[2] ..... H04R 1/02

[52] U.S. Cl. ..... 179/1 UW; 340/8 PC; 181/149

[58] Field of Search ..... 179/1 UW, 179, 184; 181/149; 340/8 PC

[56] References Cited

U.S. PATENT DOCUMENTS

| | | | |
|---|---|---|---|
| 3,789,166 | 1/1974 | Sebesta | 179/179 |
| 3,987,258 | 10/1976 | Tsutsui | 181/149 |

FOREIGN PATENT DOCUMENTS

| | | | |
|---|---|---|---|
| 617,794 | 2/1961 | Italy | 179/1 UW |

*Primary Examiner*—Kathleen H. Claffy
*Assistant Examiner*—E. S. Kemeny
*Attorney, Agent, or Firm*—Lowhurst & Aine

[57] ABSTRACT

A moisture protective housing for a sound transducer located inside the face mask of a diver which face mask is vented to a breathing apparatus, such as a scuba tank with regulator, to maintain the air breathed by the diver at substantially the same pressure as the water surrounding the diver. The housing includes a deformable portion having pin prick perforations or pores therethrough to make that portion porous when formed. The number of perforations or pores, as well as their size, are selected such that the porous portion becomes permeable to air and/or water only if the pressure differential across it exceeds a preselected value.

5 Claims, 2 Drawing Figures

PROTECTIVE COVER FOR SOUND TRANSDUCERS LOCATED IN FACE MASKS OF DIVERS

BACKGROUND OF THE INVENTION

This invention relates to underwater communication systems, and more particularly to a protective cover for the sound transducer of the communication system which is usually located inside the face mask of the diver and which needs protection from moisture.

The term sound transducer, as used herein, includes not only the microphone but also the speaker even though the invention will be described with special emphasis on the microphone.

Since the face mask of a diver, even though normally dry and maintained, through breathing, at an air pressure equal to the ambient water pressure, there are times when the face mask interior is flushed with water. This may happen accidentally when the mask is ripped off or becomes defective or intentionally when the diver wants to flush the mask for cleaning the inside of the face plate. It has therefore been found necessary to protect the microphone (or speaker), located inside the mask, from the water to prevent damage or deterioration of the transducer.

Prior art moisture protective housings for transducers, and other objects including cameras, have taken on one of two different forms. One form involving total encapsulation and the other form involving a collapsible bladder. In case of the encapsulation, the housing must have rigid walls which are designed to withstand the pressure to which the diver descends. Typically, at a depth of 330 feet, the pressure would be about five atmospheres so that such a housing must be fairly sturdy to be able to withstand such pressure without collapsing. One of the disadvantages of such a rigid housing is that the quality of sound transmission across the housing wall is poor, one reason being the difference between the internal and external pressure of the housing and another reason being the barrier of the housing material itself, which is not normally transparent to sound waves. The sound from sound transducers encapsulated in a rigid housing usually suffers so much distortion and is reduced so much in fidelity to make sound communication fairly unsatisfactory.

To decrease distortion and increase fidelity, a bladder type housing is often used. Such a housing, which surrounds the microphone is usually flexible and hermetically sealed and made of a material which is far more transparent to sound waves than the rigid housing previously discussed. To prevent the bladder from being tightly compressed against the microphone, it is filled with air at an atmospheric pressure and is made of such a size that it reduces the interior volume to a size not too small to provide good sound transmission at the maximum desired depth. It has been found that, for a microphone to operate efficiently, the cavity surrounding it should not be less than a certain minimum size. And, to assure that at the maximum desired depth, the pressure on the bladder does not reduce the interior volume too much below the optimum minimum volume, the bladder must usually be fairly large. At 5 atmospheres of water pressure, which is a normal maximum diving depth, the volume of the bladder will be reduced to one-fifth of its original volume. Even though such a housing has been found fairly satisfactory as providing low distortion and high fidelity, the problem is its size at sea level pressure because, in order to maintain adequate minimum interior space around the microphone, the bladder must be larger than a face mask can conveniently accommodate.

SUMMARY OF THE INVENTION

The protective housing of the present invention overcomes these difficulties by utilizing an envelope around the transducer that has a wall portion that becomes porous when slightly deformed so that the interior volume remains of substantially constant size and the internal and external pressures are substantially equal. More particuarly, the housing of this invention is made of a sound transparent material, such as rubber, which has a flexible portion but is designed to maintain its shape. The flexible portion is provided with pin prick perforations of such number and size to allow air to flow out or into the housing when the pressure across it exceeds a certain selected value, such as the equivalent of five or ten feet of water, and deforms the portion.

In this manner, the pressure differential across the protective housing is always small which allows the housing to remain at a selected optimum size. The housing does not require strong walls to withstand great pressure differential, does not have to be rigid, and will protect anything placed into its interior from water damage in all cases except if the housing is exposed to the water and the diver descends over a distance greater than the preselected distance to cause the flexible portion to become porous or permeable. This is a situation which is most unlikely to happen because, as long as the diver breathes, the face mask will be clear of water and in case of trouble, the natural tendency for the diver is to rise towards the surface and not to descend further.

DETAILED DESCRIPTION OF THE INVENTION

Figure 1:
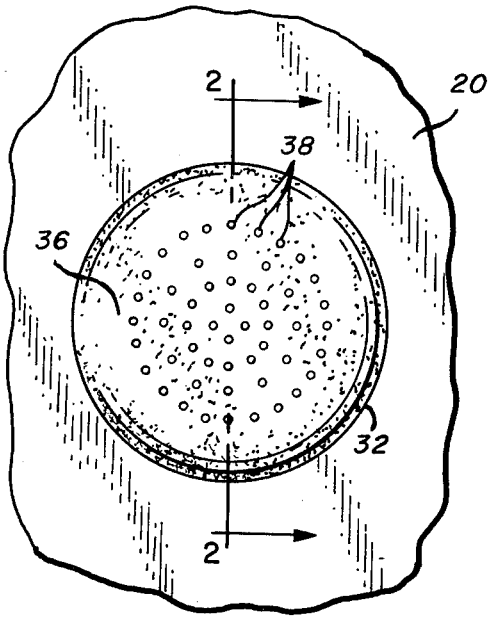
FIG. 1 shows a view, in elevation, of the protective housing of the present invention looking at the porous portion and a cut-out portion of the interior of the face mask.
Figure 2:
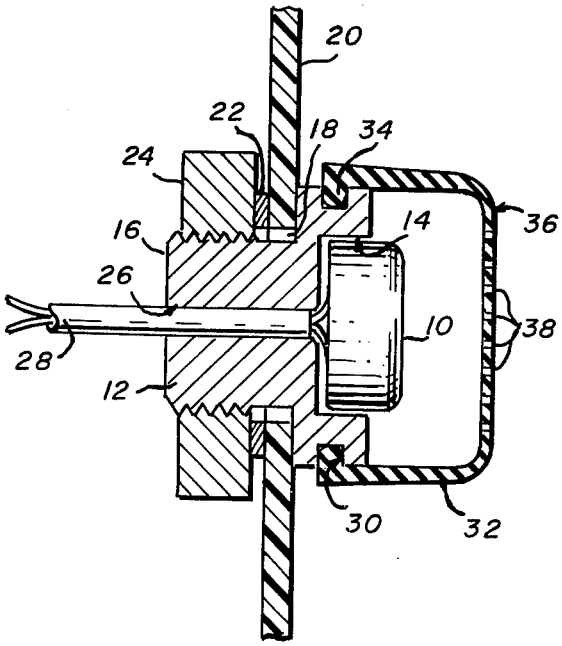
FIG. 2 is a section taken along line 2—2 of FIG. 1 showing a cross-sectional view of the protective housing covering a microphone placed in a microphone holder attached to a wall portion of the face mask.

Referring now to the drawing, a sound transducer, such as microphone 10, is placed in a microphone holder 12 which may be constructed of a plastic material such as Delren or ABS. Holder 12 includes a cylindrical opening on one side thereof which is dimensioned to approximately accommodate microphone 10, and a threaded boss 16 of reduced diameter on the other side thereof which is inserted through an appropriate opening 18 into a face mask of which only portion 20 is shown. A washer 22 is placed over the threaded boss on the other side of face mask portion 20 and nut 24 engages threaded boss 16 and is tightened so that microphone holder 12 is hermetically and securely sealed to face mask portion 20 with cylindrical cavity 14 facing the inside of the mask, and more particularly, the mouth of the user. There is also provided a central bore 26 in microphone holder 12 through which a microphone cable 28, hermetically sealed to holder 12, is passed for connection to microphone 10. Microphone holder 12 is also provided with an external groove 30 on the peripheral portion inside the face mask which is designed and dimensioned to accommodate the lip of protective housing 32.

Protective cover 32 is of cup-like configuration with a lip 34 which is dimensioned to engage recess 30 in holder 12. The side walls of housing 32 are preferably thicker than the bottom face of the cup so that the housing walls retain their natural shape when a pressure differential exists between the interior and exterior of the housing, and distortion is limited to bottom face 36 of the housing also referred to as flexible wall 36. Typically, the side walls may have a thickness of 0.030 inches and the bottom face may have a thickness of approximately half that amount, the side walls being somewhat tapered for a smooth transition between side wall thickness and bottom face thickness.

Bottom wall 36 is provided with a plurality of pin holes, such as approximately 50 in number, which are made by pin pricking the bottom wall with a needle-like tool such as used by dentists. Generally speaking, the pin holes, in combination with the material which is typically selected to be rubber or an elastic substance, is such that the bottom wall is not permeable, either to air or to water, unless there is a differential in pressure across that wall to cause the wall to deform. The number of holes, as well as the diameter of the pin prick tool, is selected so that permeability or porosity results when the pressure across the bottom wall exceeds a preselected amount such as, for example, the equivalent of five or perhaps ten feet of water, this amounting to about 10 to 20 lbs. per square inch. As a result of such an election, the pressure differential between the interior and the exterior of housing 32, the exterior being the interior of the face mask, never exceeds a preselected pressure differential.

As far as the operation of the moisture protective housing of this invention is concerned, it is clear that as a pressure differential builds up across the bottom wall of the housing, the same is deformed. Such deformation has been found to cause the small pin prick holes to stretch open and pass a substance either out or into the interior of the protective housing until the pressures are substantially equalized or, at least, until the pressure differential across the bottom wall is less than the preselected pressure at which the wall becomes permeable. A typical pressure differential that has been achieved with a housing as illustrated, utilizing rubber and providing 50 pin prick holes with a dental instrument has been 10 lbs. per square inch.

With such a differential in mind, a diver, who has just descended to a depth of 100 feet, will find the interior of the protective housing to be at a pressure which is about 10 feet above his position which is around 90 feet. If, for some reason the mask becomes flooded at that depth whether accidentally or on purpose, the pressure inside the protective cover will keep any moisture out. If the diver should ascend without clearing the mask, the pressure inside the protective housing will continuously be greater than the water pressure and no moisture will go into the cover. Only should the diver flood his mask and then continue his descent, a situation which is not normally encountered under controlled circumstances, the water pressure will exceed the pressure inside the protective housing and moisture will seep into the protective housing.

There has been described a protective housing for a sound transducer or similar device which can be carried by a diver inside the face mask, which is inexpensive and which provides high fidelity and low distortion to sound. Even though this invention has been described with particular emphasis on a protective cover for a microphone, it is to be understood that the same is equally applicable for other sound transducing devices such as, for example, speakers. Further, the protective cover may also be used for devices other than sound transducing devices such as, for example, cameras or any other instrument or devices which a diver may like to take under water and which are to be protected from moisture and are placed in an environment which changes its pressure as the diver descends such as, for example, the interior of the face mask.

What is claimed is:

1. A moisture protective housing for a sound transducer mounted within the face mask of a diver comprising:

a base member attachable to the interior of the face mask for holding said transducer and for making hermetically sealed electrical connection thereto;

a cover enveloping said transducer and sealingly engaging said base member; said cover having a deformable portion; and a plurality of pin prick type perforations in said deformable portion, the size and number of said perforations being selected so that said perforated portion becomes permeable only if and when the pressure differential across said deformable portion exceeds a preselected value.

2. A protective housing in accordance with claim 1 in which said cover is of cup-like shape and said deformable portion is the bottom wall.

3. A protective housing in accordance with claim 2 in which the side walls of said cover are thicker than said bottom wall so that deformation is limited to said bottom wall.

4. A protective housing in accordance with claim 1 in which said cover, with the exception of said flexible portion, retains its shape when the pressure differential across said cover is no greater than said preselected value.

5. A protective housing in accordance with claim 1 in which said cover is constructed of an acoustically transparent material to allow transmission of the sound waves from said transducer into the interior of the face mask.

* * * * *